United States Patent [19]

Friedman et al.

[11] 4,445,625

[45] May 1, 1984

[54] VENDING MACHINE HAVING ACCESS BLOCKING MEMBERS

[76] Inventors: Evelyn Friedman; William R. Carswell, both of P.O. Box 149, Whitehall, N.Y. 12887

[21] Appl. No.: 414,381

[22] Filed: Sep. 2, 1982

Related U.S. Application Data

[63] Continuation-in-part of Ser. No. 284,330, Jul. 17, 1981, Pat. No. 4,410,104.

[51] Int. Cl.[3] ..... B65H 31/20

[52] U.S. Cl. ..... 221/241; 221/279

[58] Field of Search ..... 221/241, 226, 227, 231, 221/232, 279; 194/2

[56] References Cited

U.S. PATENT DOCUMENTS 4,236,650 12/1980 Medley ..... 221/226

*Primary Examiner*—Stanley H. Tollberg

*Attorney, Agent, or Firm*—Edgar N. Jay

[57] ABSTRACT

A vending apparatus well suited for vending such articles as newspapers, magazines or the like which vary in size, in which the articles to be vended are supplied to one side of an access opening in the vending apparatus enclosure. Access opening gating structure normally in a closed position prevent removal of an article unless, after paying a prescribed fee, the customer operates a gating actuator to cause the gating structure to be shifted to an open position in which an article can be removed through the access opening. Removal of the article causes the release of the gating structure permitting it to be returned to its normally closed position. In a preferred embodiment, the gating means includes at least two mutually independently movable blocking members which normally close the access opening.

5 Claims, 12 Drawing Figures

Fig. 4A
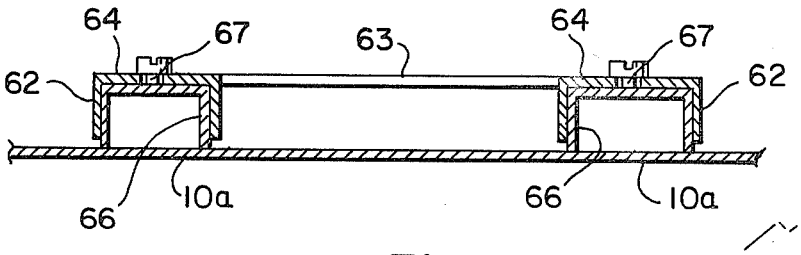
Fig. 3
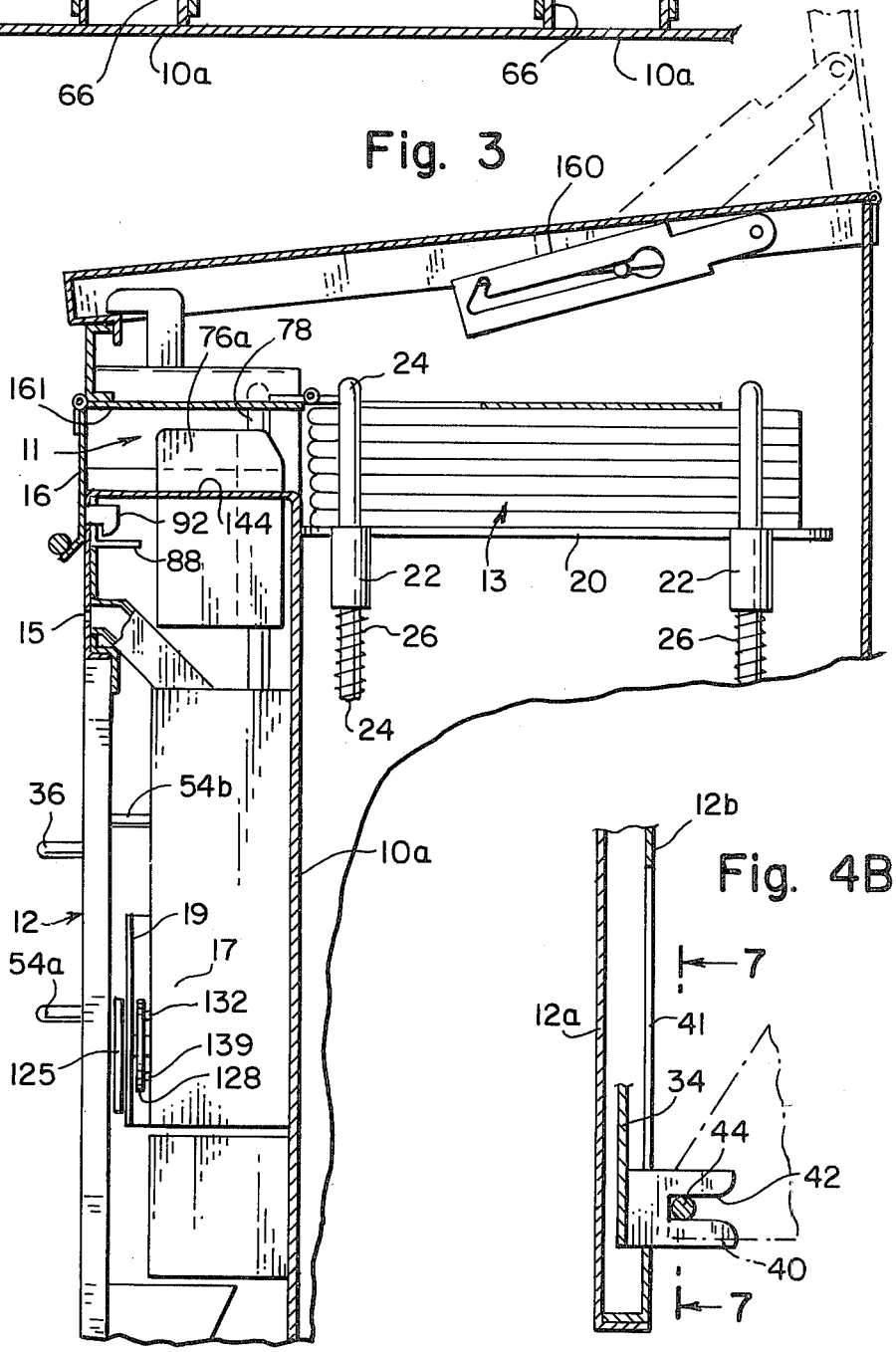
Fig. 4B 70
78
70
161
6
144
76
90
85
76
72
6
76a
84
72
81
81
96
77a
5
69
82
94
74
86
74
79
102
102
100
79a
100
104
80
104
69
79b
110
5
67
67
62
63
62
4A
54b
54c
37
56
36
52
57
4A
67
54
140
19
34
50
125a
130
127
44
37a
125
123
40
4B
32

74
108
102
106
100
104
110
66

12b
41
12b
170
175
173
171
173a
174
172
42
40

161
16
144
92
88
85
84a
98
10d
84
75
96
74
82
86

VENDING MACHINE HAVING ACCESS BLOCKING MEMBERS

This application is a continuation-in-part of our copending U.S. Pat. application No. 284,330, filed July 17, 1981 U.S. Pat. No. 4,410,104.

This invention relates to a vending apparatus for such articles as newspapers, magazines or the like of the type set forth in said copending application No. 284,330 and, in order to avoid unnecessary repetition here, the disclosure of said copending application in its entirety is incorporated here by reference thereto. More particularly, the present application relates to such apparatus having improved security against improper removal of an article therefrom.

In the vending apparatus of our prior application U.S. Pat. No. 284,330, access opening gating means [73] comprises a pair of blocking pins [78] connected adjacent to their lower ends to a cross bar [74]. In that arrangement, a downward force on one of the blocking pins [78] is transmitted to the other through a cross bar [74]. As a result, it is possible to prevent both blocking pins [78] from being returned upward to their blocking position by obstructing one of them.

It is, therefore, a principal object of this invention to provide such an apparatus with improved gating means controlling access to the articles to be vended after the deposit of the required amount of money.

In carrying out the present invention, means are provided for delivering the articles to be vended to a position adjacent an access opening through which the article or articles can be removed by a customer following deposit of the required amount of money and operation of the vending machine in a prescribed manner. A unique feature of the present invention resides in access opening control means including gating means which, unless actuated by the customer following deposit of the prescribed amount of money, prevents withdrawal of articles through the access opening. In a preferred embodiment, the gating means comprises at least two independently movable blocking members which normally obstruct the access opening to prevent the removal of articles. Following deposit of the required fee and actuation of the vending machine, the gating means is actuated to shift each of the blocking members to its second position permitting withdrawal of an article through the access opening. Removal of the article actuates the gating means to return the blocking members to their starting positions obstructing the access opening.

Further objects as well as advantages of the invention will be apparent from the following detailed description thereof and the accompanying drawings in which FIG. 1 is a perspective view of the vending machine with a portion of the outer panel of its front door partially cut away for convenience;

FIG. 3 is a side elevational view partially in section of the upper portion of the vending machine on an enlarged scale;

FIG. 4A is a fragmentary sectional view along the line 4A—4A of FIG. 4 in the direction indicated;

FIG. 4B is a partial sectional view through the line 4B—4B of FIG. 4 in the direction indicated;

Figure 1:
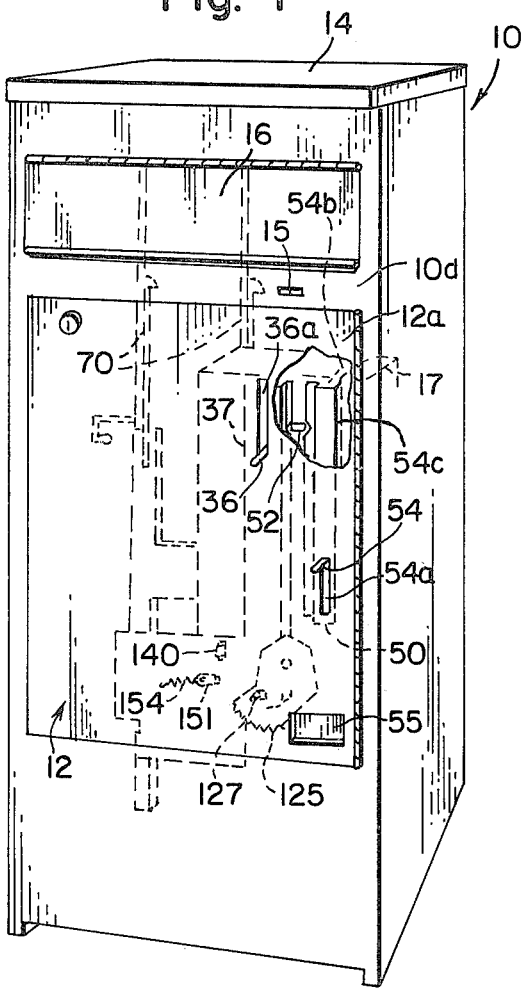

Referring now to the drawings, which show a preferred embodiment, and, in particular, to FIGS. 1, 2, 3 and 4, the vending apparatus comprises an enclosure 10 having a hinge-mounted front door 12. Enclosure 10 is preferably formed with a transverse wall **10*a* forming a front compartment 10*b* with the inner surface of front door 12 and a larger rear compartment 10*c* for a supply of articles to be vended. Front compartment 10*b* is closed at its top by a plate-like member 144 which also forms the floor or lower boundary of the area leading to access opening 11. In the arrangement shown, a hinge-mounted top cover 14 provides ready access, when open, for the loading of a supply of articles to be vended indicated generally at 13. An access opening indicated generally at 11 is provided through which articles 13 are removed by a customer. If desired, the outer or front end of access opening 11 may be secured by a flap door 16 horizontally hinge mounted to the enclosure 10 above the front door 12**.

Figure 8:
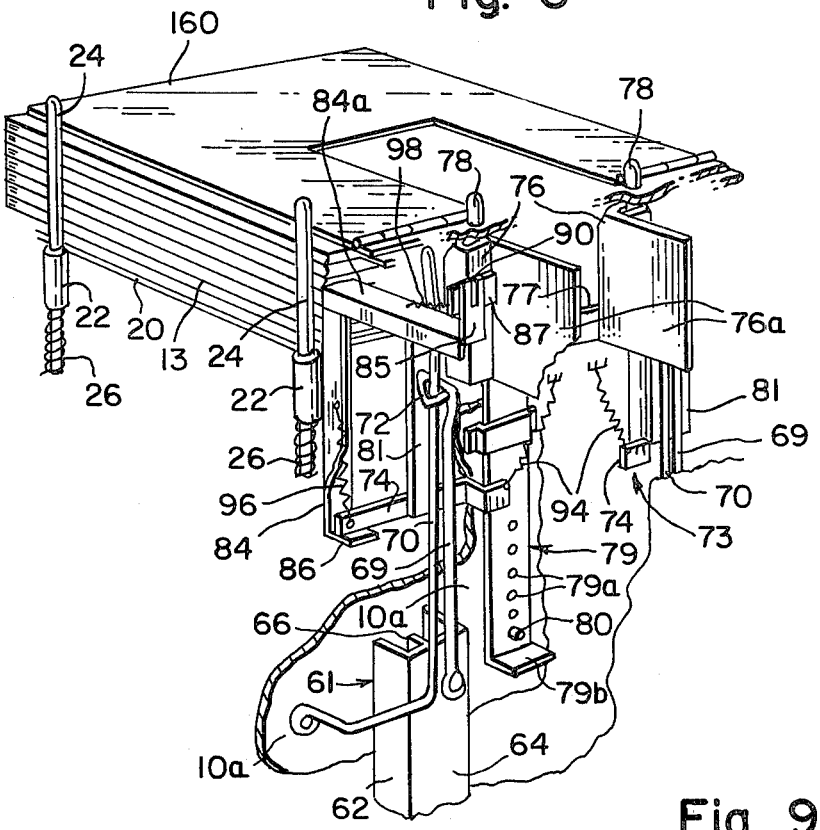
FIG. 8 is a perspective view showing the gating means and means for adjusting the size of the access opening.

While any desired arrangement including a continuous feeding arrangement may be used, the articles 13 to be vended, as best shown in FIGS. 3 and 8, are preferably stacked within the rear compartment **10*c*. One convenient arrangement that is preferred for feeding the articles is to position the articles 13 upon a platform 20 slidably mounted on vertical rod-shaped support members 24 by means of bushings 22 which engage and are urged upward by coil springs 26 mounted on each of the members 24, whereby the platform 20 and articles 13 stacked upon it are biased upward to their uppermost position with the upper article 13 against a hinged stop or cover plate 160 to ensure a continuous supply of articles to the access opening 11**.

It may well be to note here that it is immaterial to the present invention whether the vending apparatus is adapted to respond to money in the form of paper money or coins. The present preferred embodiment is constructed to respond to coins and will be described in conjunction with a coin mechanism. Thus, referring once again to FIG. 1, slot 15 is provided in the front wall **10*d* of enclosure 10 and communicates with a coin mechanism 17**, the details of which form no part of the present invention and which is indicated schematically. A preferred device is one manufactured and sold by National Rejectors Industries, Division of UMC Industries, Inc., Hot Springs, Ark., under the designation No.

13-03-054 SCS Module. As is well known in the art, actuation of coin mechanism 17 following deposit of a predetermined amount of money results in actuation of a release member such as rotation of a notched disk 18 (FIG. 9) which, as will be more fully pointed out hereinbelow, permits a customer to complete operation of the vending apparatus.

Figure 3A:
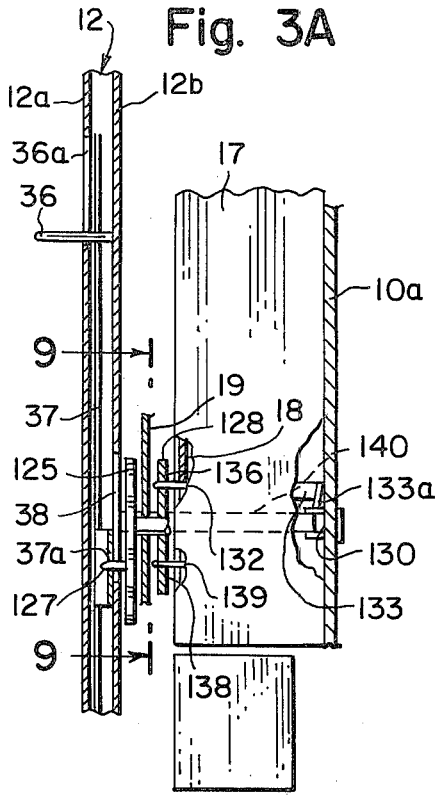
FIG. 3A is a vertical sectional view on a somewhat enlarged scale of the lower portion of the apparatus shown in FIG. 3.
Figure 2:
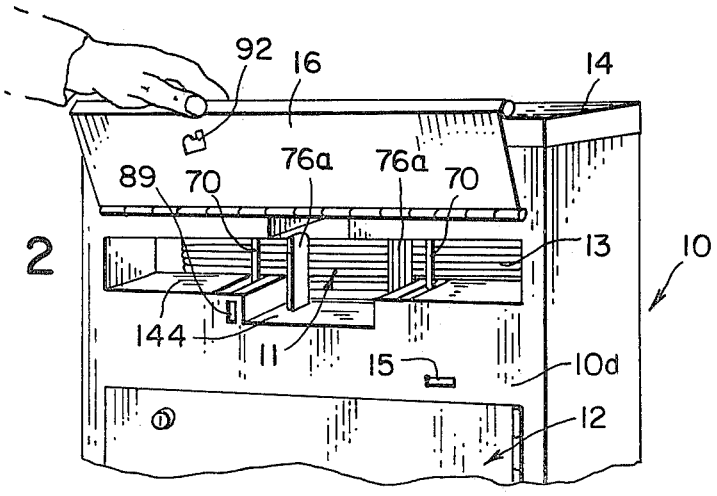
FIG. 2 is a perspective view showing the upper portion of the vending machine with its outer flap open and exposing the access opening and a portion of the gating means controlling the removal of articles.

As is most clearly shown in FIGS. 1, 3 and 3A, a cam shaft 130 is rotatably mounted adjacent one end thereof in a support plate member 19 through which it extends and adjacent to its rearward end is rotatably supported by transverse wall 10*a*. Support plate member 19 is mounted just within the opening closed by front door 12. An operating plate 125 having a toothed sector 123 is fixed to cam shaft 130 adjacent to the front end thereof so as to be juxtaposed to the inner surface of front door 12 when the latter is closed. A drive pin 127 is fixed to operating plate 125 spaced from cam shaft 130 and, with front door 12 closed as shown in FIG. 3, extends into engagement with a slide member 37 of actuating assembly 32, slide member 37 having slot 37*a* (FIG. 3A) formed therein for that purpose. Slide member 37 is slidably mounted in front door 12 with an extended portion thereof vertically slidable in slot 38 formed in the rearward presented side 12*b* of front door 12.

Slide member 37 is part of an actuating assembly 32 which is slidably mounted within the front door 12, between front and rear panels 12*a* and 12*b* thereof. In addition to slide member 37, the actuating assembly 32 includes a yoke member 34 rigidly connected to slide member 37 for movement therewith. As is most clearly shown in FIG. 4B, yoke member 34, remote from slide member 37, has a rearwardly extending bifurcated portion or flange 40 which extends rearwardly through an elongated vertically extending slot 41 formed in the rear panel 12*b* of the front door 12 to engage a pin 44 adjacent the lower end of access opening control means 60 yet to be described.

As shown in FIGS. 1 and 3, slide member 37 has fixed thereto an elongated delivery or operating handle 36 which extends forwardly through a vertical slot 36*a* formed in door front panel 12*a*. As shown in FIGS. 1 and 3, delivery handle 36 is in its lowered or starting position.

Also slidably mounted within front door 12, is an elongated coin return member 50 located in close-spaced side-by-side relation with actuating slide member 37. Coin return member 50 carries a handle 54 which extends forwardly through a slot 54*a* (FIG. 1) formed in front panel 12*a* of door 12 and a pin 54*b* which extends rearwardly through a slot 54*c* in rear panel 12*b* to engage the coin mechanism 17. As is well known in the art and need not be further described here, downward actuation of coin return handle 54 following deposit of coins in the coin slot 15 results in the coins being returned via coin return chute 55.

Figure 4:
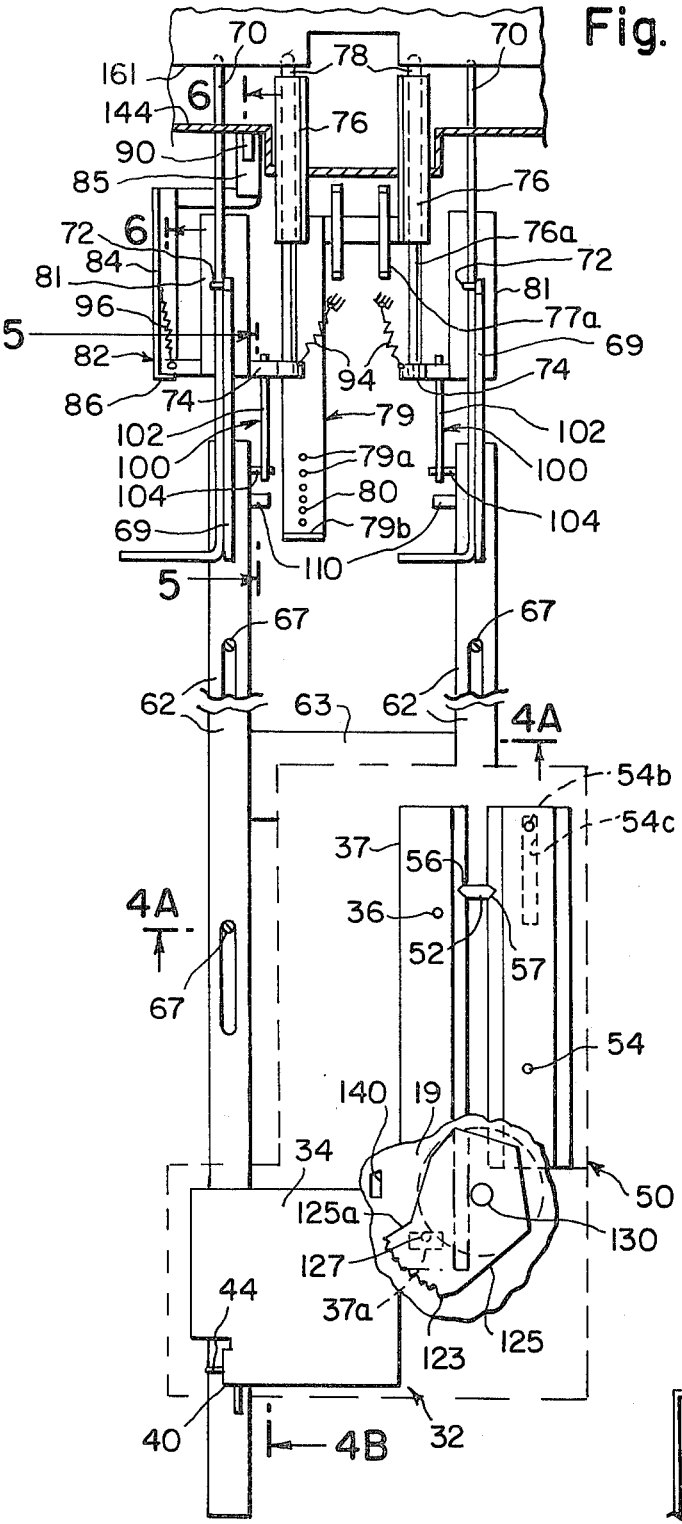
FIG. 4 is a front elevational view, partially in section and broken away, of the actuating and gating assemblies with the various parts in their normal unactuated positions with the gating means blocking the access opening.

As is most clearly shown in FIG. 4, a lockout member 52 is slidably supported between the actuating slide member 37 and the coin return member 50 so that operation of one of these members by a customer prevents operation of the other unless the first to be operated is returned to its start position. To this end, with the actuating slide member 37 and the coin return member 50 in their starting positions, two juxtaposed notches, notch 56 formed in slide member 37 and notch 57 formed in coin return member 50, are aligned so that lockout member 52 is free to enter one or the other of the notches 56, 57 depending upon whether the slide member 37 or the coin return member 50 is operated first, the other being thereby locked against vertical displacement by the lockout member 52 until the displaced member is returned to its start position.

As best shown in FIGS. 4 and 4A, access opening control means 60 comprises actuating means 61 and gating means 73 responsive thereto. Actuating means 61, in turn, includes a pair of elongated actuators 62 connected together by a plate 63. Each of the actuators 62, as shown, has a longitudinal flange 64 to facilitate slidably connecting the same to vertically extending support flanges 66 connected to and extending from adjacent the bottom to adjacent the top of transverse wall 10*a*. Each of the flanges 66 has two elongated slots 67, only one of which is shown in FIG. 4A, which extend vertically along flange 66. Actuator flange 64 is slidably connected to the support flange 66 by means of suitable fasteners 67*a*, one of which passes through each of the support flange slots 67. Adjacent to its lower end, the left actuator 62 (as viewed in FIG. 4) carries the laterally extending pin 44 which, with door 12 closed as most clearly shown in FIG. 4B, extends through the slot 42 in the bifurcated flange 40 of the yoke 34. Thus, when flange 40 is carried up on operation of delivery handle 36 to raise slide member 37, pin 44 is driven upward thereby raising the gating actuating means 61. Adjacent to their upper ends, the actuators 62 each carries resilient means preferably in the form of an elongated resilient member 69 having a substantially horizontally extending loop 72 and biased rearwardly for engaging the gating means 73 as is yet to be described. A pair of resilient elongated members 70 are provided, one extending along each of the members 69 and through the loop 72 formed therein. The lower ends of the members 70 are fixed to the transverse wall 10*a*, the other end portions of the members 70 extending upward above the loop 72. As is most clearly shown in FIG. 3, top cover 14 in its closed position is positioned spaced above stop plate 160. Stop plate 160 is hinged to closure member 161 and the latter is connected to the side and front walls of enclosure 10, forming the top of the access area leading to access opening 11. Closure member 161 has a pair of spaced openings formed therein through which the upper end portions of each of the resilient members 70 extends and are free to move, the latter being long enough so that they extend adjacent to the closure member 161 when actuators 62 are in their lowered position.

Figure 7:
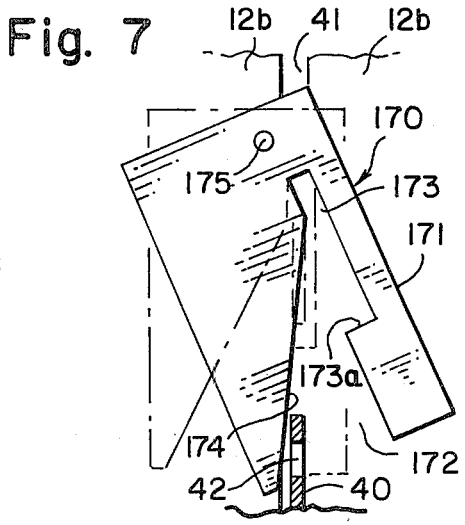
FIG. 7 is a fragmentary view taken through the line 7—7 of FIG. 4B in the direction indicated showing means for retarding operation of the apparatus.

It is desirable to prevent excessively rapid return of the operating handle 36 to its lowered position so as to minimize the risk of a malfunction. A preferred retarding means 170 comprises a generally rectangular plate 171 connected by a pivot pin 175 to the rear panel 12*b* of front door 12. As is most clearly shown in FIG. 7, plate 171 is connected to front door 12 so that a slot 173 formed therein is in registration with bifurcated flange 40 carried by yoke member 34 and with slot 41 formed in rear panel 12*b* when the plate is positioned with its slot 173 extending substantially vertically. Slot 173 opens diagonally downward through a slot 172, the left edge 174 of which, as viewed in FIG. 7, functions as a camming surface as now will be described. It should be first noted that pivot pin 175 supports plate 171 well to the right of its vertical axis so that the bulk of its weight under the force of gravity urges the plate 171 to rotate counterclockwise. When a customer raises delivery handle 36 after depositing the required amount of money, flange 40 is carried upward on yoke 34, the latter being connected to slide member 37 on which handle 36 is mounted. As flange 40 rises it causes plate 171 to rotate clockwise (FIG. 7) until, at the top of its upward travel flange 40 is positioned in slot 173. Now as flange 40 moves downward in response to downward movement of delivery handle 36 by the customer, plate 171 will be free to rotate counterclockwise once the upper end of flange 40 clears the upper end portion of slot 173. The rate of rotation of plate 171 counterclockwise is such that if the flange 40 moves downward too rapidly it will encounter the bottom 173*a* of slot 173 so that its downward travel will be arrested until plate 171 has substantially completed its rotation.

Preferred means for readily adjusting the access opening 11 through which articles 13 are removed by a customer is most clearly shown in FIGS. 4 and 8 and comprises a pair of spaced generally tubular members 76 which extend upward through openings in plate-like member 144. Tubular members 76 are joined by a strap 77 retained in slidable engagement with transverse wall 10*a* below plate-like member 144 in any suitable manner such as by brackets 77*a* fixed to the wall 10*a*. Each of the tubular members carries a relatively large area guard plate 76*a* which projects forwardly from the access opening 11 and which together serve to restrict the movement of a customer's hand. As shown, an arm 79 depending from strap 77, has a series of aligned openings 79*a* formed therein for receiving the free end portion of an adjusting pin 80 fixed to transverse wall 10*a* in a suitable location such that engagement of successive openings 79*a* with the pin 80 serves to raise or lower strap 77 and the tubular members 76 carried thereby a corresponding amount in front of the access opening 11 above plate-like member 144. A finger piece 79*b* formed by a bent over end portion of arm 79 facilitates movement of the strap 77 to adjust the position of tubular member 76 and thereby the access opening 11.

Gating means 73 comprises a pair of blocking pins or members 78, one for each of the tubular members 76 through which each extends as most clearly shown in FIGS. 4 and 8. Adjacent their lower ends, blocking members 78 are each connected to a respective carriage in the form of a cross bar 74. Rails 75 (only one of which are shown) are fixed to transverse wall 10*a* and are vertically slotted to receive the opposite end portions of the associated cross bar 74 and support the latter in vertically movable relation to the wall 10*a*. As shown most clearly in FIGS. 4 and 8, each cross bar 74 has fixed thereto a finger 81 aligned with and positioned for engagement by the loop 72 on resilient member 69 associated therewith when, after having been raised, the actuators 62 are moved downward. One end of an associated one of a pair of springs 94 is connected to each cross bar 74, and the other end of each of the springs 94 is connected to transverse wall 10*a* so as to bias the cross bars 74 upward and return them to their raised position when they and the parts carried thereby are free to move. When the cross bars 74 and blocking members 78 carried thereby are in their raised position, the access opening 11 is blocked, and no articles can be removed therethrough. When, as a result of operation of handle 36 to move slide member 37 and yoke 34 downward, actuators 62 are carried downward by the engagement of pin 44 in bifurcated flange 40, the resilient members 69 by their loops 72 engage the cross bar fingers 81 and force the cross bars 74 downward withdrawing blocking members 78 into their respective tubular members 76. With the blocking members 78 thus withdrawn, the upper ends of the tubular members 76 serve to define the effective size of the access opening and thereby limit the article or articles to be removed in accordance with the position of arm 79 relative to adjusting pin 80.

Figure 5:
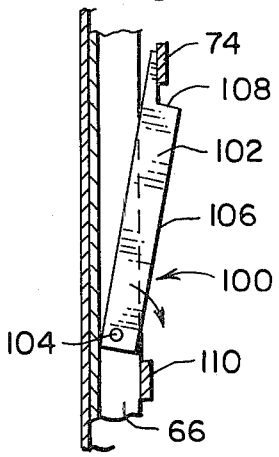
FIG. 5 is a sectional view along the line 5—5 of FIG. 4 showing, on an enlarged scale, an anti-tampering assembly.

Referring to FIGS. 4 and 5, a pair of keeper means 100 for preventing or stopping unauthorized movement of blocking members 78 may be provided, and a preferred arrangement comprises, for each of the blocking members 78, a keeper 102 connected to a support flange 66 by a pivot pin 104. As shown in FIG. 5, each keeper 102 is formed with a recess or notch 108 in its upper portion to receive the cross bar 74 associated therewith and is supported by pin 104 so that it is urged clockwise under the influence of gravity as viewed in FIG. 5. The forwardly presented edge 106 of each keeper 102 is positioned to be engaged by a tang 110 carried by each actuator 62 as the latter are moved to their raised positions so that the keepers 102 are rotated (counterclockwise as shown in FIG. 5) carrying the upper end portion of their respective keepers 102 far enough to the rear of the associated cross bar 74 so that the latter cross bars 74 are free to descend under the influence of resilient members 69 as resilient members 69 are moved downward with their actuators 62. The arrangement is such that loops 72 on the resilient members 69 in engagement with fingers 81 carried by cross bars 74 move the latter downward in front of the leading edge 106 of its associated keeper 102 so that the latter cannot prevent further downward movement of its cross bar 74 and the blocking members 78 carried thereby. When, after handle 36 has been moved to its fully lowered position and the customer removes an article 13 through the access opening 11, the article 13 in its passage moves the resilient members 70 to carry members 69 and then loops 72 out of engagement with fingers 81. Thus, as soon as the trailing end of article 13 has cleared the gating means, cross bars 74 carrying blocking members 78 and fingers 81 are free to rise under the influence of the return springs 94 and are thereby moved to their raised position with blocking members 78 once again in position across the access opening 11 to prevent removal of additional articles. As cross bars 74 arrive at their raised position and because actuators 62 are in their lowered position with tangs 110 out of the way of the leading edge 106 of keepers 102, the latter are free to rotate (clockwise in FIG. 5) under the influence of gravity and to fall under the cross bars 74 thereby preventing the blocking members 78 from being pushed out of the access opening 11.

Figure 6:
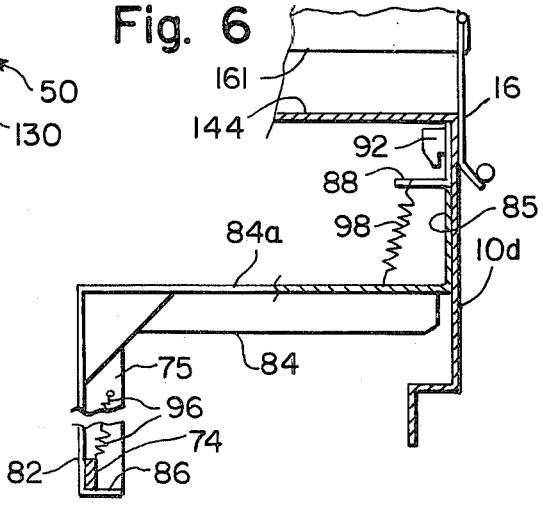
FIG. 6 is a partial sectional view along the line 6—6 of FIG. 4 showing the front flap locking assembly.

When a latch is desired for the flap door 16 a preferred construction is one in which the latching means is controlled by the gating means to minimize the risk of the flap door 16 becoming accidentally locked before the customer has removed the article 13. To this end, an inverted L-shaped member 84 is slidably mounted on rail 75 positioned to the left of the cross bars 74 (FIGS. 4, 6 and 8) and is vertically movable thereon. The horizontally extending portion of inverted L-shaped member 84 forms a lever 84*a* which carries a catch 85. Catch 85 extends upwardly from lever 84*a* and its upper, bifurcated end nests between a pair of spaced, upwardly extending arms 87 of a bracket 88. Bracket 88 is fastened, as by welding, to the inner face of the front wall 10*d* of enclosure 10 in registration with latch opening 89 (FIGS. 2 and 6) formed in the front wall. A latching spring 98 has one end connected to bracket 88 and its other end connected to catch lever 84*a* and is tensioned to normally bias inverted L-shaped member 84 to its raised position so that catch 85 engages latch 92 on flap door 16 to lock the latter. An opening spring 96 has one end connected to cross arm 74 and the other end to catch lever 84*a*, the force of opening spring 96 being sufficiently greater than that of latching spring 98 that the latter can only bias catch 85 to its raised latching position when opening spring 96 is not extended. Opening spring 96 is always sufficiently extended to overcome latching spring 98 except when the associated cross bar 74 is in or close to its upper position and the access opening 11 is closed by the gating means 73.

Figure 9:
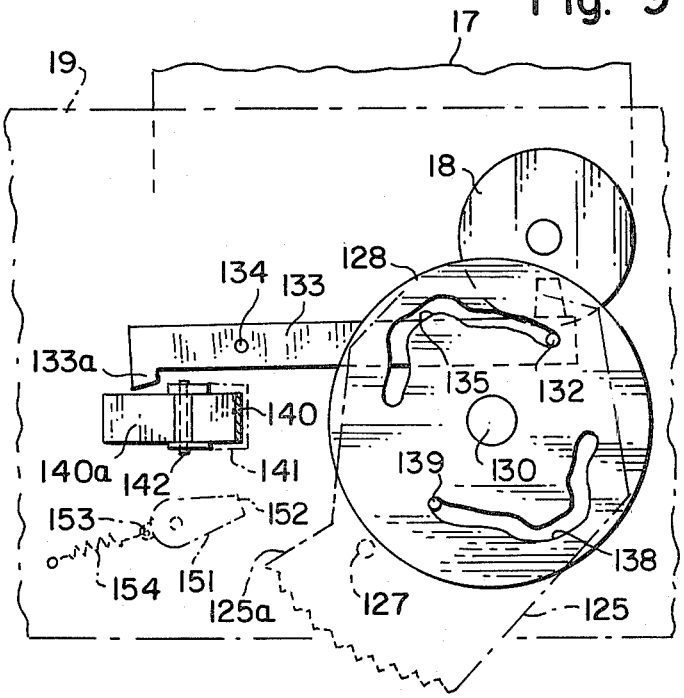
FIG. 9 is a fragmentary sectional view taken through the line 9—9 of FIG. 3A in the direction indicated.

At the start of operation of the apparatus, delivery handle 36 is in its lowered position as shown in the drawings, the gating means is raised with blocking members 78 obstructing the access opening, and, if constructed as shown, flap door 16 is latched. Initial upward movement of delivery handle 36 serves to rotate operating plate 125, its pin 127 being engaged by slide member 37, until its leading edge 125*a* engages a blocking member or dog 140 unless the blocking member 140 because of actuation of the coin mechanism 17 has been shunted out of the way. As is well known and forms no part of the present invention, coin or money collecting mechanisms are customarily positioned to control operation of a vending apparatus in response to deposit of a predetermined amount of money. As shown in FIGS. 3 and 9, a cam plate 128 having a circumferentially extending cam slot 136 is fixed to cam shaft 130 for rotation therewith and with operating plate 125. Initial rotation of cam shaft 130 serves to displace cam slot 136 clockwise (FIG. 9) bringing a pin 132 to a radially outward extending portion of slot 136. The right end portion of pin 132, as indicated in FIG. 3, is juxtaposed to the periphery of disk 18 having a peripheral notch. The position of the notch in disk 18 is controlled by coin mechanism 17, as is well known, and need not be described here. Suffice it to say here that, unless the required amount of money has been deposited and not returned, the notch in disk 18 will be out of alignment with pin 136, and further rotation of operating plate 125 is prevented by the blocking member 140. On the other hand, if the notch in disk 18 is aligned with pin 132, the latter is cammed upwards.

The forwardly presented end portion of blocking member 140 projects through an opening 141 formed in support plate 19. The rearward portion of blocking member 140 extends at right angles to the front part and substantially parallel to transverse wall 10*a* to form the tang portion 140*a*. The tang portion 140*a*, adjacent to the main body of the blocking member 140 is supported by vertically extending pin 142 so as to be pivotable about the vertical axis of pin 142. A lever 133 pivotally supported from transverse wall 10*a* by pin 134 is formed with an inclined spur 133*a* positioned to engage the tang portion 140*a* of blocking member 140. The other end of lever 133 is engaged by pin 132 and is free to be raised thereby when pin 132 is forced upward by cam plate 128.

Thus, when pin 132 is forced up on continued rotation of cam plate 128, lever 133 is pivoted counterclockwise (FIG. 9) carrying its spur 133*a* down. This downward movement of spur 133*a* engaging tang 140*a* causes the blocking member 140 to rotate and shift its forward end to the left (FIGS. 1 and 9) clear of the path of operating plate leading edge 125*a*. Continued rotation of operating plate 125 carries its leading edge into engagement with means for preventing return of the operating plate 125 to its start position until operating handle 36 has been raised to the top of its slot 36*a* and the operating plate 125 has completed its clockwise rotation (FIG. 1).

As most clearly shown in FIG. 1, a detent or anti-backup member 151 is pivotally connected to support plate 19 with its nose 152 positioned to intercept the operating plate leading edge 125*a*. Detent tail 153 is engaged by a spring 154, the other end of which is connected to support plate 19. Rotation of operating plate 125 clockwise (FIG. 1) causes it to deflect detent nose 152 upward and permitting its toothed sector 123 to pass the detent. If an attempt should be made to reverse the operating plate 125 while its toothed sector 123 engages detent nose 152 the parts lock and further rotation is prevented until the already initiated rotation is resumed and completed. It is to be understood that detent 151 functions in the manner just described during both the start of operation when delivery handle 36 is raised and completion thereof when the delivery handle 36 is lowered except that operating plate 125 being rotated counterclockwise to its start position, the detent nose 152 is deflected downward.

At the same time that pin 132 is raised by cam plate 128, pin 139 is forced down to actuate a coin collecting means (not shown), thereby delivering the money to a coin box so that the coins which actuated mechanism 17 are no longer in a position to be returned by coin return member 50.

It is believed that the operation of the apparatus of the present invention has been fully described herein above and further discussion thereof is not required here. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A vending apparatus having an enclosure with an access opening formed therein for removal of an article therethrough from one side thereof by a customer on payment of a fee, means for supplying articles to be vended to the other side of said access opening, access opening control means including gating means and gating actuating means, said gating means being movable between a first position blocking removal of any articles through said access opening and a second position in which at least one article can be removed through said access opening, said gating actuating means being operable from a starting condition to an intermediate condition to shift said gating means from its first position to its second position and releasably retain said gating means in its said second position, said gating actuating means being responsive to removal of an article through said access opening to release said gating means, and resilient means for shifting said gating means from its second position to its first position following release thereof by said gating actuating means, wherein the improvement comprises, said gating means including at least two blocking members, and support means movably supporting said blocking members for mutually independent movement between said first and second positions with said blocking members in said first position extending across said access opening and blocking the same.

2. An apparatus as set forth in claim 1 in which said gating means further includes a plurality of mutually independent carriages, one for each of said blocking members.

3. An apparatus as set forth in claim 1 or 2 in which said gating actuating means includes a pair of resilient elongated members one of which is movably supported and is adapted for releasably retaining said gating means in its said second position, the other of said resilient members extending in said access opening for actuation when an article is removed through said access opening, and said other resilient member when so actuated releasing said gating means.

4. An apparatus as set forth in claim 3 in which said gating actuating means includes at least two pairs of said resilient elongated members, one pair associated with each of said blocking members.

5. An apparatus as set forth in claim 4 which includes means for adjusting the size of said access opening.

* * * * *